United States Patent [19]

Vanderminden et al.

[11] Patent Number: 4,514,009

[45] Date of Patent: Apr. 30, 1985

[54] COLLAPSIBLE LOUNGE CHAIR

[75] Inventors: Robert D. Vanderminden, Granville, N.Y.; Paul Parker, Poultney, Vt.

[73] Assignee: The Telescope Folding Furniture Co. Inc., Granville, N.Y.

[21] Appl. No.: 424,627

[22] Filed: Sep. 27, 1982

[51] Int. Cl.[3] ..... A47C 4/00; A47C 1/02

[52] U.S. Cl. ..... 297/27; 297/16; 297/35; 297/359

[58] Field of Search ..... 297/359, 27, 28, 16, 297/19, 35, 105, 118

[56] References Cited

U.S. PATENT DOCUMENTS 2,972,373 2/1961 Thomas ..... 297/28
3,285,654 11/1966 Cramer ..... 297/35
3,495,868 2/1970 Vanderminden ..... 297/27
3,972,562 8/1976 Montrose ..... 297/359

FOREIGN PATENT DOCUMENTS 202308 3/1959 Austria ..... 297/27
800907 9/1958 United Kingdom ..... 297/27

*Primary Examiner*—James T. McCall
*Attorney, Agent, or Firm*—Kenyon & Kenyon

[57] ABSTRACT

The lounge chair is not only pivotal from an upright position into a reclined position via the use of telescoping arms of the arm frame but also collapsible from the upright position into a folded position via hinges at the rear of the chair. The chair can be easily transported and stored in the collapsed condition by either laying flat or by standing upright.

7 Claims, 5 Drawing Figures

COLLAPSIBLE LOUNGE CHAIR

This invention relates to a collapsible lounge chair. More particularly, this invention relates to a collapsible lounge chair for outdoor use.

Heretofore, various types of lounge chairs have been known for outdoor use. For example, lounge chairs of the backrest type which are used at poolside or on beaches have generally been constructed with a set which is situated at a limited height above ground to permit an occupant's legs to be extended substantially horizontally in a rest position. In some cases, these lounge chairs have been constructed of three generally U-shaped frames such that one frame forms a seat frame, a second frame forms an arm frame and a third frame forms a back frame. Usually, the frames have been articulated to each other to permit folding of the chair from an upright position to a collapsed condition. However, these chairs provide only one position for an occupant, i.e. the upright position.

Another known type of back-rest chair, for example as described in U.S. Pat. No. 3,495,868, has a back portion which is capable of being pivoted into substantial horizontal alignment with a seat portion to assume a lay-flat position. In addition, the back portion includes a curved end portion with a crossbar which is adapted to rest on the ground when the chair is in the lay-flat position. However, in order to permit pivoting of the back portion relative to the seat portion, the chair has been constructed with armrests which are pivotally secured to the back portion and slidably secured in a mount or bracket of the seat portion. In addition, the underside of each armrest is provided with a series of aligned holes or notches for receiving the upper portion of the mount so as to lock the armrest with respect to the seat portion. Guides are also provided to retain each mount in alignment with the holes in the underside of an armrest. However, such a construction is cumbersome to use, particularly if the armrests are not lifted from the respective mounts simultaneously to shift the back portion of the chair to another position.

Accordingly, it is an object of the invention to provide a lounge chair of backrest type which can be moved between a raised upright position and a lowered reclined position and which can be collapsed for ease of transport and storage.

It is another object of the invention to provide an adjustable lounge chair of backrest type which can be readily collapsed.

It is another object of the invention to provide a relatively simple means for collapsing an adjustable lounge chair of the backrest type.

Briefly, the invention provides an adjustable lounge chair which has a seat frame, an arm frame and a back frame which can be pivoted between a collapsed position and an upright position as well as between the upright position and a lowered reclined position. The arm frame is pivotally connected to the seat frame and is constructed to define a second leg support while including a pair of extendable arms. The back frame is pivotally mounted on the seat frame and is pivotally secured to the two extendable arms to move between the raised upright position and the lowered reclined position. In addition, the back frame has a projecting portion at one end which defines a third leg support when in the lowered position and includes a back which extends across the back frame.

The lounge chair also has a pair of hinges which pivotally mount the back frame to the seat frame to enable the back frame to be pivoted between the various positions of use. Each hinge is pivotally connected to the leg support of the seat frame as well as to the lower end of the back frame to permit pivoting of the back frame into a selected position of use.

The chair also has means located on the arm frame for releasably holding the back frame in the raised position. For example, with the arm frame including a pair of parallel tubular arms with a telescoping arm slidably received in each respective arm, the releasable means includes a spring biased button which is housed within a respective telescoping arm for projection through an aperture in the tubular arm when the chair is in the raised upright position.

In use, for example, when the chair is in the upright position, the occupant may push the respective buttons of the holding means into the arms. This serves to release the telescoping arms so that the back frame may pivot rearwardly into the lowered reclined position. At this time, the telescoping arms simply slide within the tubular arms of the arm frame until the leg support of the back frame comes into contact with the ground surface. The occupant may then assume a fully reclined positon.

In order to move from the upright position to the collapsed position, for example, in order to carry the chair, the occupant removes himself from the chair and then pivots the back frame and/or the seat frame towards each other to collapse the chair. During this time, the buttons of the releasable holding means keep the telescoping arms in place.

These and other objects and advantages of the invention will become more apparent from the following detailed description taken in conjunction with the accompanying drawings wherein.

Figure 1:
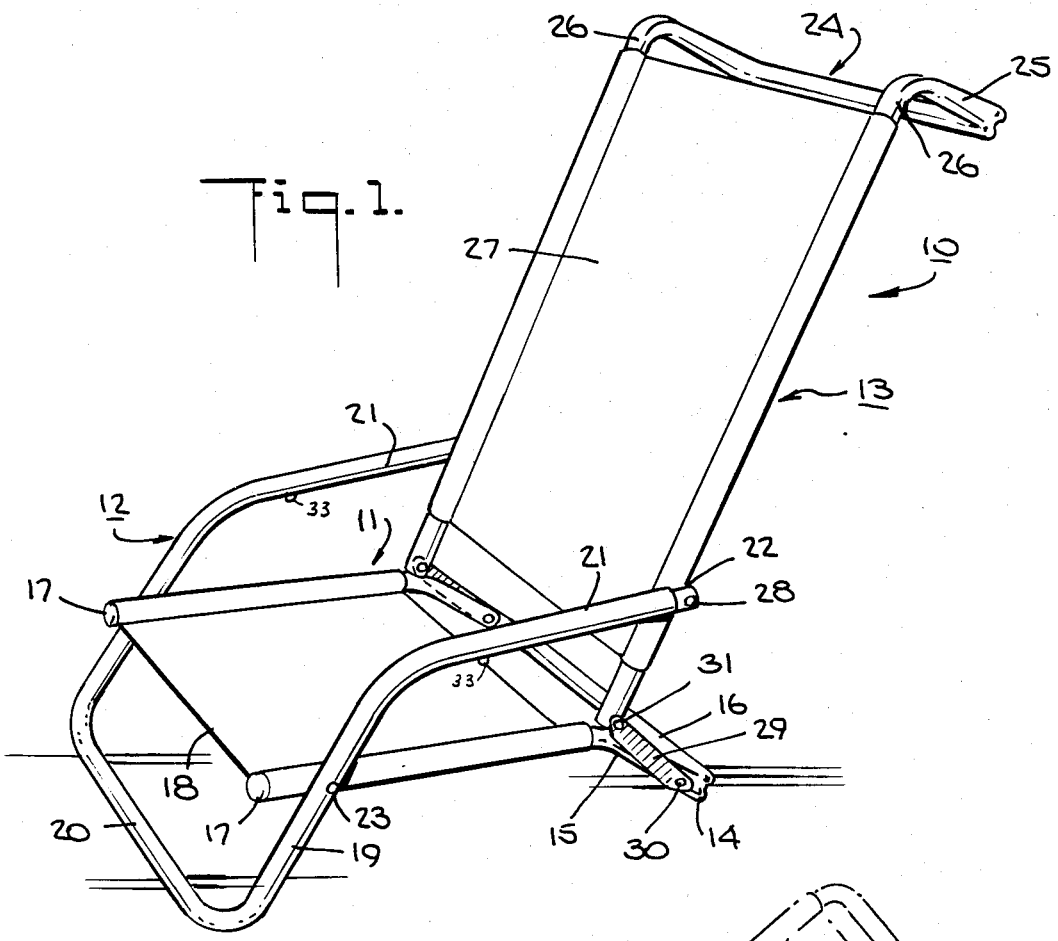
FIG. 1 illustrates a perspective view of the lounge chair in an upright position in accordance with the invention.

Refering to FIG. 1 the adjustable lounge chair 10 is constructed with a seat frame 11, an arm frame 12 and a back frame 13.

The seat frame 11 is formed of a generally U-shaped one-piece hollow tubular member 14 which is bent at one end to define a leg support 15. As indicated, a crossbar 16 of the tubular member 14 rests on a ground surface while a pair of parallel arms 17 of the member 14 supports a seat 18 which extends across the frame 14. The seat 18 may be of any suitable material, such as a woven fabric material, a web material, or the like.

Figures 3, 4, 5:
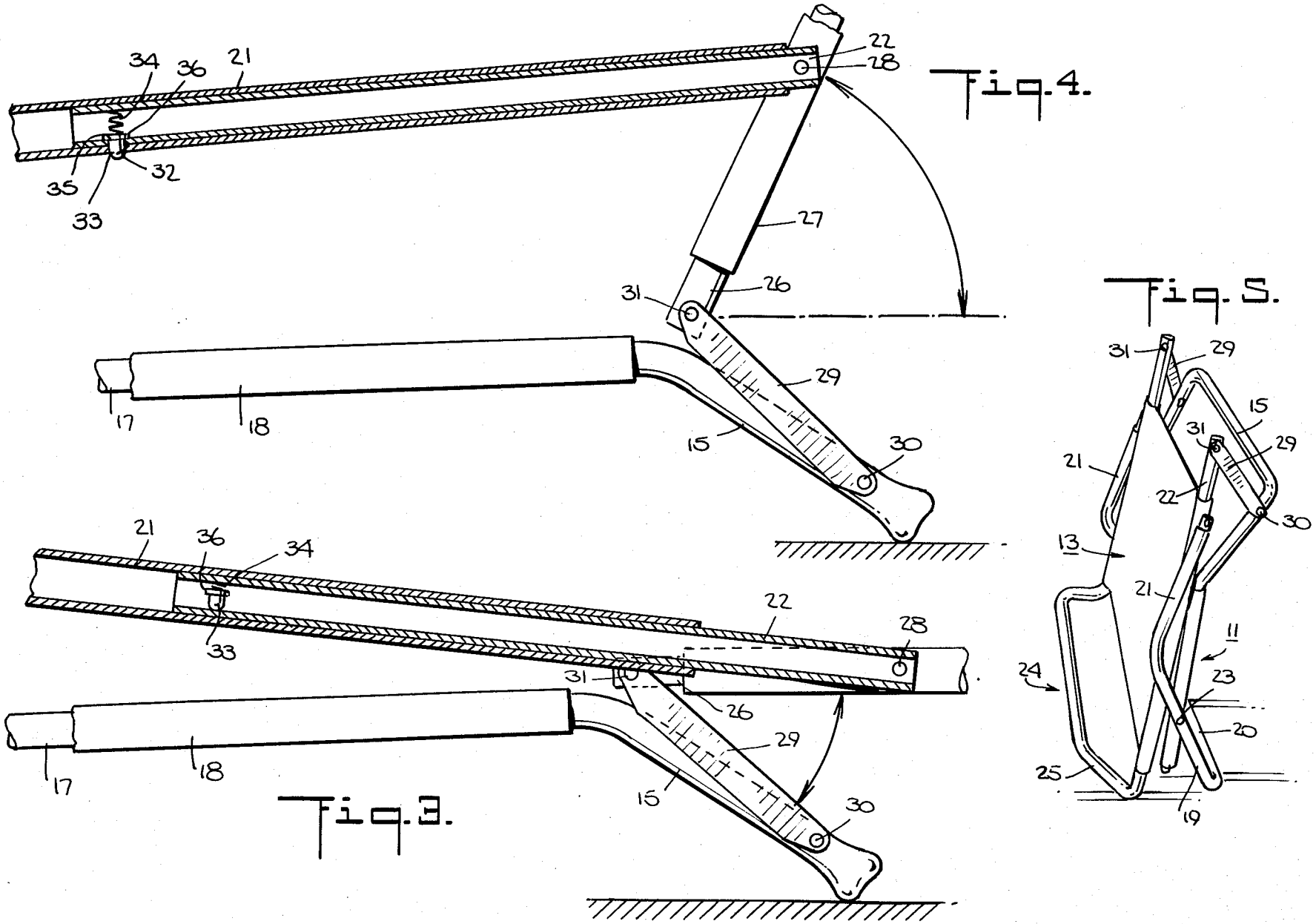
FIG. 3 illustrates a view of the lounge chair in a collapsed position.
FIG. 4 illustrates a partial fragmentary view of the lounge chair in the upright position.
FIG. 5 illustrates a view of the collapsed chair in a self-standing position.

The arm frame 12 is also formed of a generally U-shaped one-piece hollow tubular member 19 which is bent at an intermediate point. As indicated, the tubular member 19 defines a leg support 20 and a pair of parallel arms 21 above the seat frame 11. In addition, the arm frame 12 includes a pair of telescoping arms 22 each of which is slidably received in a respective arm 21. As shown in FIGS. 3 and 4, each arm 21 is of hollow cylindrical shape while each telescoping arm 22 is in the form of a tube of cylindrical shape which is slidably received within an arm 21.

Referring to FIG. 1, the arm frame 12 is pivotally connected to the seat frame 11, for example via threaded bolts 23 which are passed through the arms 21 of the arm frame 12 into the arms 17 of the seat frame 11 in known manner.

The back frame 13 is also formed of a generally U-shaped one-piece hollow tubular member 24. The tubular member 24 is bent at the upper end, as viewed, to have a projecting portion which defines a third leg support 25 when in a lowered position. The tubular member 24 also has a pair of parallel arms 26 across which a back 27 extends. As above, the back 27 can be formed of any suitable material, such as a fabric or webbing.

As shown, the back frame 13 is pivotally secured to the arm frame 12 at an intermediate point. For example, each telescoping tube 22 of the arm frame 12 is pivotally secured to an arm 26 of the back frame 13 as by a pin or bolt 28 which passes through the tube 22 into the arm 26, for example in the same fashion as the arm frame 12 is pivotally secured to the seat frame 11.

Figure 2:
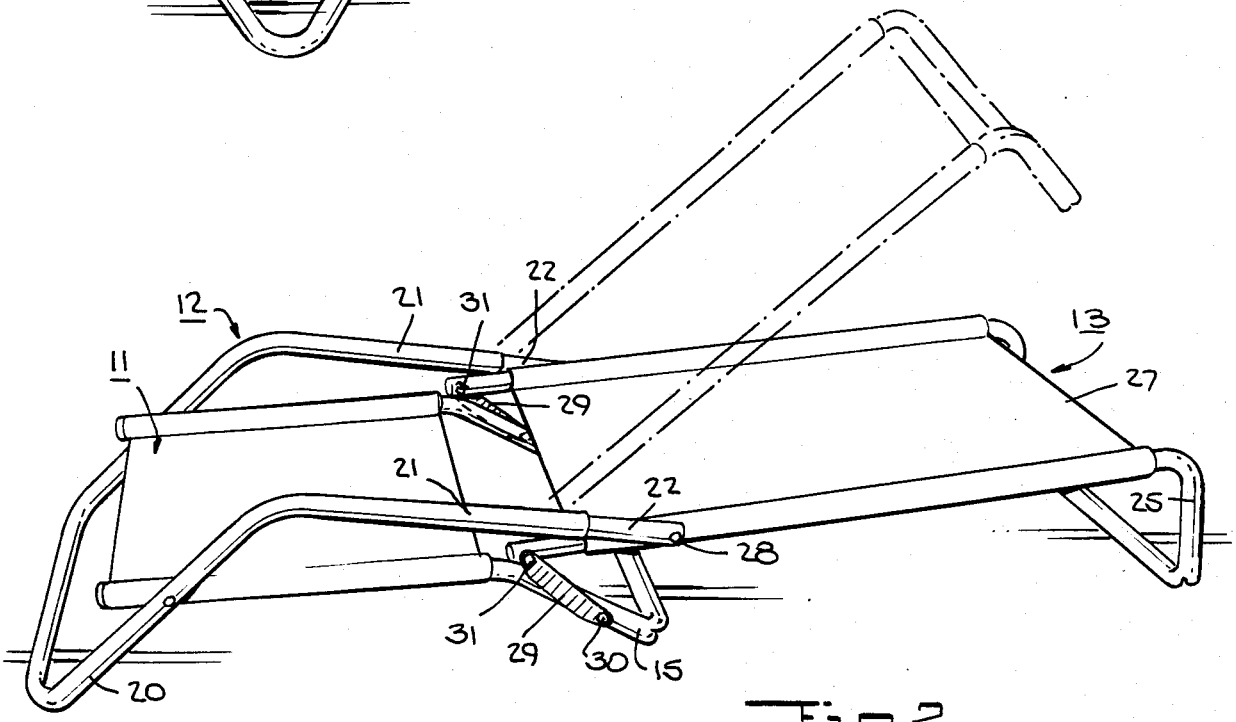
FIG. 2 illustrates a view of the lounge chair in a lowered reclined position in accordance with the invention.

The back frame 13 is also pivotally secured to the seat frame 11 via a pair of hinges 29 so as to permit pivoting of the back frame 13 from the upright position shown in FIG. 1 to a lowered reclined position as shown in FIG. 2 as well as from the upright position to a collapsed or folded position as shown in FIG. 3. Each hinge 29 is formed by a single lever or bar which is pivotally connected at one end to the leg support 15 of the seat frame 11, as by a pin or rivet 30, and at the opposite end to the lower end of an arm 26 of the back frame 13 as by a pin or rivet 31. As shown, each lever 28 is shaped at the respective ends to lie within the contour of the leg supports 15 and arms 26 at least in the upright position of the chair 10.

Referring to FIG. 4, the chair 10 is also provided with means for releasably holding the back frame 13 in the raised position. For example, the means includes an aperture 32 in each arm 21 of the arm frame 12, a button 33 which is housed within a respective telescoping tube 22 and a spring 34 which biases the button 33 outwardly. As indicated, each button 33 projects through an aperture 35 in a tube 22 and carries a collar 36 which acts as a stop against the inside of the tube 22 in the locking position, i.e., the upright position of the chair 10.

When the chair 10 is in the upright position, as shown in FIG. 1, each button 33 projects through the respective arm 21 of the arm frame 12. When the chair 10 is in the reclined position, for example as shown in FIG. 2, each button 33 is disposed within a respective tubular arm 21.

When in use, the chair 10 can be readily moved from the upright position shown in FIG. 1 in which the chair 10 rests on the two leg supports 15, 20 to the reclined position shown in FIG. 2 wherein the chair 10 rests on the three leg supports 15, 20 and 25. To this end, the occupant merely grasps the arms 21 and depresses the buttons 34 into the arms 21. At this time, the telescoping tubes 22 are released so that the occupant, by leaning against the back frame 13, can pivot the back frame 13 into the reclined position shown in FIG. 2. In this latter position, the back 27 is in generally parallel relation with the seat 18 so as to comfortably receive an occupant in a reclining position.

In order to collapse the chair 10 from the upright position shown in FIG. 1, for example, for ease of transport or storage, the occupant removes himself from the chair 10 and then pivots the back frame 13 forwardly towards the leg frame 11 and into the collapsed position shown in FIG. 3.

Of note, when the back frame 13 pivots from the upright position to the reclined position, the back frame 13 pivots about the axis of the pins 31 while the arms 22 of the arm frame 12 extend. When the back frame 13 pivots forwardly from the upright position to the collapsed position, the back frame 13 pivots while the arms 22 remain locked in place. At this time, the hinges 29 pivot clockwise, as viewed in FIG. 3, about the axis of the pins 30 while the back frame 13 pivots counterclockwise about the axis of the pins 28.

As shown in FIG. 3, when collapsed, the back frame 13 is disposed within the contour of the arm frame 12. In this position, the chair 10 presents a relatively flat compact appearance. In addition, the folded chair 10 may be carried by grasping the cross-bar of any one of three leg supports 15, 20, 25. Further, the folded chair 10 may be stood upright via the front and rear leg supports 20, 25 in a free-standing manner as shown in FIG. 5. In this position, the leg supports 20, 25 are spaced apart to provide a base of sufficient width to permit the chair to stand vertically without tipping.

The invention thus provides a lounge chair of backrest type which is not only adjustable between an upright position and a reclining position but is also collapsible in a compact folded position for ease of transportation and storage.

What is claimed is:

1. A collapsible lounge chair comprising a seat frame defining a first leg support;

an arm frame pivotally connected to said seat frame and defining a second leg support, said arm frame including a pair of telescoping arms; and a back frame pivotally mounted on said seat frame to move between a raised upright position and a lowered reclined position and between said upright position and a collapsed position, said back frame having a projecting portion at one end to define a third leg support in said lowered position and being pivotally secured at an intermediate portion to each telescoping arm.

2. A collapsible lounge chair as set forth in claim 1 which further comprises means for releasably holding said back frame in said raised position.

3. A collapsible lounge chair as set forth in claim 1 which further comprises a pair of hinges pivotally mounting said back frame on said seat frame, each said hinge being pivotally connected to said first leg support and pivotally connected to a lower end of said back frame.

4. A collapsible loung chair as set forth in claim 3 wherein each hinge is a single lever.

5. A collapsible lounge chair comprising a seat frame defining a first leg support;

an arm frame pivotally connected to said seat frame and defining a second leg support, said arm frame having a pair of extendable arms;

a back frame pivotally connected to said arms and having a projecting portion at one end to define a third leg portion; and a pair of hinges pivotally mounting said back frame on said seat frame to pivot between a collapsible position and an upright position and a lowered reclined position.

6. A collapsible lounge chair as set forth in claim 5 wherein each hinge is pivotally connected to said first leg support and pivotally connected to a lower end of said back frame.

7. A collapsible lounge chair as set forth in claim 5 wherein each hinge is a single lever.

* * * * *